US006178678B1

(12) United States Patent
Stoddard

(10) Patent No.: US 6,178,678 B1
(45) Date of Patent: Jan. 30, 2001

(54) MENU BOARD GRAPHICS DISPLAY

(75) Inventor: David C F Stoddard, Atlanta, GA (US)

(73) Assignee: Miller/Zell, Inc., Atlanta, GA (US)

( * ) Notice: Under 35 U.S.C. 154(b), the term of this patent shall be extended for 0 days.

(21) Appl. No.: 08/978,498

(22) Filed: Nov. 25, 1997

(51) Int. Cl.[7] ..... G09F 7/02
(52) U.S. Cl. ..... 40/618
(58) Field of Search ..... 40/618, 657, 605, 40/654

(56) References Cited

U.S. PATENT DOCUMENTS

| | | | |
|---|---|---|---|
| 2,795,876 | 6/1957 | Hayes | 40/1.5 |
| 4,367,604 | 1/1983 | Porter, II et al. . | |
| 5,224,610 | 7/1993 | Veazey . | |
| 5,357,701 | 10/1994 | Grate . | |
| 5,367,800 | 11/1994 | Nelson | 40/18 |
| 5,487,231 | 1/1996 | Grate | 40/618 |
| 5,588,238 | 12/1996 | Visocky et al. | 40/618 |

FOREIGN PATENT DOCUMENTS

| | | | |
|---|---|---|---|
| 354488 | 2/1990 | (EP) | 40/605 |
| 399957 | 11/1990 | (EP) | 40/605 |

OTHER PUBLICATIONS

Hubert catalog excerpt, Euroline Price Tags (Date Unknown).

*Primary Examiner*—Cassandra H. Davis
(74) *Attorney, Agent, or Firm*—Womble Carlyle; Sandridge & Rice, PLLC

(57) ABSTRACT

A menu board offering quick and easy changes thereto by a user is disclosed. The menu board comprises plural channels defined by T-shaped flanges, and which are sized to slidably receive and retain a plurality of inserts in the channels thereof in an operative or display position. The inserts are sized to be readily removed and replaced on the menu board by being lifted within the respective channels and to be freed therefrom, such that the user can selectively replace an insert with new or updated sales information graphics, as desired, without disturbing an adjacent insert or inserts in the menu board. The sales information graphic is not limited to the size of the channels on the menu board, but may transversely span any desired number of channels, and be of various lengths to provide relatively large non-linear graphic display areas.

3 Claims, 5 Drawing Sheets

MENU BOARD GRAPHICS DISPLAY

FIELD OF THE INVENTION

The invention relates in general to advertising displays. More particularly, the invention relates to a menu board graphics display constructed and arranged for the quick and easy change of advertising/display messages placed on the menu board.

BACKGROUND OF THE INVENTION

The present invention is directed to a menu board offering changeable pricing and graphics for providing greater flexibility in usage so that changes to the offerings and messages communicated by the display may be quickly and efficiently changed.

The film developing business represents a prime example where the needs offered by the present invention can be utilized. Film developing services have evolved over the last several decades, from developing conventional black and white film, to the present services of one-hour or overnight film developing services, in which a wide variety of film types and sizes, selective film finishes, and other services and products may be selected by the consumer. To adapt to these variety of services, and to remain competitive, store owners and managers must be able to adjust quickly and to make changes to retail prices, messages, and advertisement displays for products and services, and to convey those options and prices clearly to the consumer. Further, brand images for national and private labels play an important part in establishing consumer confidence in the product offering and the developing process, and must be communicated to the customer for his ease in recognizing the values offered by the retail establishment. Image recognition also serves as a buying impetus. There may also be marketing agreements with manufacturers having well known logos that have to be incorporated into the overall rendition of the information system. The present invention provides a suitable mechanism to satisfy these needs.

There have been various attempts by others to try and meet certain of these needs, but none offer a system that is as complete and efficient as demonstrated by this invention. The various attempts are reflected in the patents discussed below.

U.S. Pat. No. 4,367,604, to Porter, II et al., discloses a menu board including a housing containing a light source, a translucent front panel, and a plurality of parallel, spaced ribs with flanges attached to the face of the panel to support pictorial and alpha-numeric information. One embodiment thereof includes a plurality of substantially parallel flanges extending along the outer surface of the menu board and arranged such that indicia bearing cards or strips can be inserted between adjacent flanges by placing the top edge of a strip, for example, in the space between the board and the downwardly extending portion of a flange, and then between the board and the upwardly extending portion of a spaced flange.

U.S. Pat. No. 5,224,610, to Veazey, discloses a permanent, wall mounted display panel board featuring plural, horizontally disposed L-shaped hanger arms and related snap arms for receiving one or a plural number of profile members, where each such member includes a hanger arm along its top and a complementary snap arm along its bottom. When the profile hanger arm of the profile member is hung on the top of the hanger arm of the wall bracket, the profile member is suspended therefrom. Further, when the respective snap arms are pressed into releasable engagement with one another, the profile member is securely held on the wall bracket.

U.S. Pat. No. 5,357,701, to Grate, discloses a display device similar to Veazey, and which discloses upper and spaced lower L-shaped rails with a pair of intermediate T-shaped rails having legs thereof spaced from a panel wall. Sliding insert panels, bearing information thereon, cooperate with any two of the rails, where different size insert panels may also be used.

U.S. Pat. No. 5,367,800, to Nelson, discloses an interchangeable display system for mounting to a support backing. The mounting includes a support backing with upper, center, and lower face panels mounted to the support backing and spaced forwardly of the support backing with two elongate slots extending lengthwise between the respective face display elements. They cooperate with the upper slot, and a lower mounting hook on the back of the respective display elements cooperates with the lower slot so that the two hooks retain the display element and can slide along the respective slots to assemble and disassemble the display element in position in front of the mounting.

U.S. Pat. No. 5,487,231, to Grate, discloses a vertically positioned attraction board having a plurality of horizontal parallel tracks, where each track includes an upper and a lower lip for retaining a figure panel therebetween.

U.S. Pat. No. 5,588,238, to Visocky et al., discloses another type of sign carrier system or menu board utilizing rails for slidably receiving information containing strips. The system thereof includes a frame comprising laterally spaced vertical or longitudinally extending grid guide rail members that have tracks, and are joined at their upper and lower ends by laterally extending cross rails to form a rigid and permanent carrier frame. Modular information grid units are adapted to slide on the guide rails, one after another, to span across the space between the vertical guide rails of the carrier frame.

Despite the presence of these patents, however, a need remains for a menu board graphics display which is of relatively simple construction, and thus lower cost, and yet which provides the features of allowing the user to quickly and easily change the display graphics placed on the menu board graphics display. There is also a need for such an improved menu board graphics display which can be used with modular display insert assemblies having graphics display information provided therewith, and which can be easily changed when, and as, desired.

SUMMARY OF THE INVENTION

The present invention overcomes some of the design deficiencies of the prior art by providing an improved menu board graphics display of simple design and construction, which is easy to use, and which can be suspended from the walls or ceiling of a store, or by means of a free-standing support. In a preferred embodiment, the menu board includes at least one channel, and preferably a plurality of multi-channel extrusions which are adapted to receive large graphics and pricing displays mounted thereon by means such as double-sided adhesive tape, channel filler extrusion inserts for the support of smaller menu slats or sign blanks, or modular display insert assemblies. The channel filler extrusion inserts are constructed and arranged to be slidably received within any one of the channels. With the channel filler inserts so received, a space is provided between the retaining wall segments or legs of the multi-channel extrusion and the channel filler extrusion insert for the insertion of a menu slat or sign blank. This eliminates the need for prominent horizontal dividers between menu slats.

Alternately, a modular display insert assembly containing a plurality of openings for the insertion of accordion-like number sets can be inserted into the channels of the multi-channel extrusion. The use of such number sets allows for easy manipulation of pricing and offers significant flexibility to the user thereof.

As a further feature hereof, the novel combination of a short upper lip and long lower lip of spaced, parallel T-shaped channel forming members of the menu board, which define the forward boundary of each channel, enables the user to quickly and easily insert and/or change out the channel filler extrusion inserts and display assemblies at any position along the channel lengths.

Accordingly, it is an object of this invention is to allow a user to replace messages, rearrange offerings and messages, or to add offerings and messages quickly and efficiently without changing or replacing the entire menu board graphics display.

Another object of this invention is to provide an improved menu board graphics display which allows a user thereof to respond rapidly to market changes by quickly changing pricing or other advertising information in their service to customers.

These and other objects will become more apparent to the person skilled in the art, especially an experienced merchandiser, from the following description, particularly when read in conjunction with the accompanying drawings.

DETAILED DESCRIPTION OF THE PREFERRED EMBODIMENTS

Figure 1A:
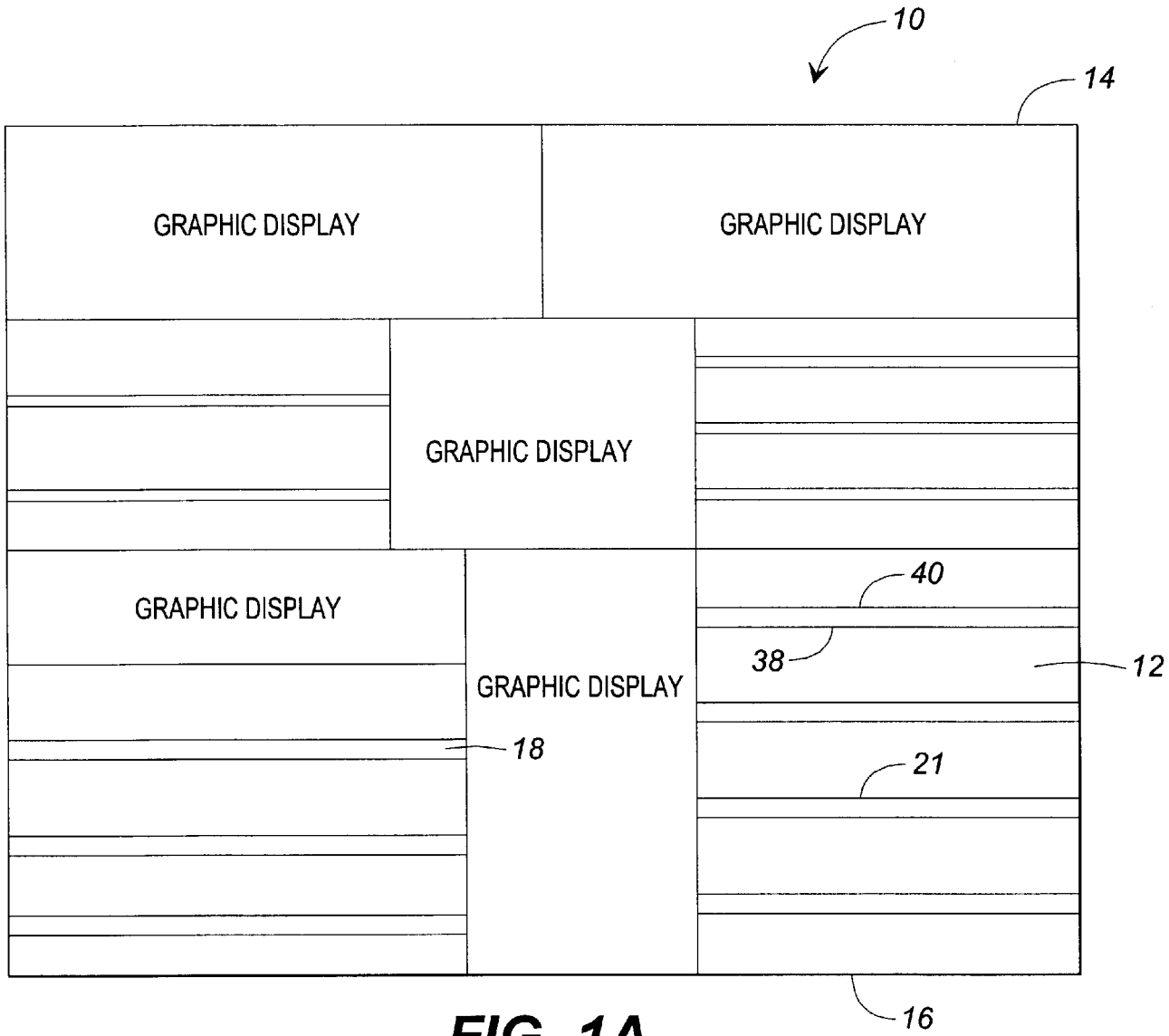
FIG. 1A is an elevational view of an exemplary menu board illustrating the plural channel dividers and channels so formed according to the present invention.

The present invention is directed to a menu board, such as may be used in a retail establishment for advertising sales and services, where the menu board offers a convenient system for the advertising, but which may be easily and quickly changed to meet marketing shifts. Referring now to the drawings, in which like reference numerals indicate like parts throughout the several views, FIGS. 1A, 2 and 3A through 3C show a preferred embodiment for the menu board of the invention.

Figure 2:
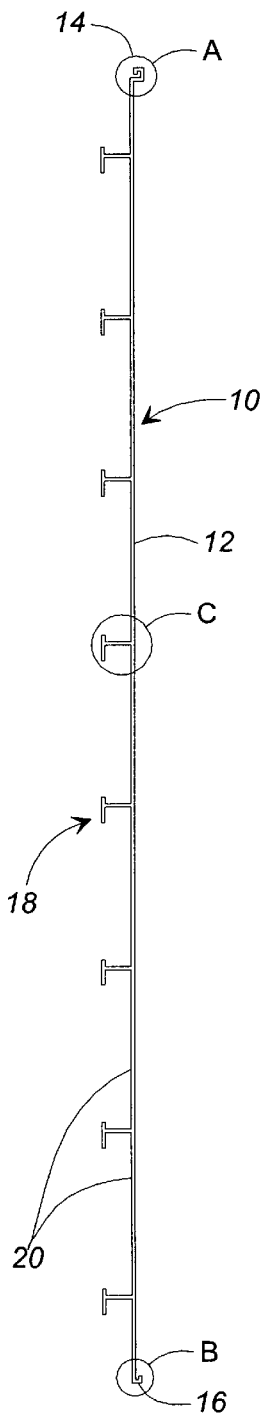
FIG. 2 is an end elevational view of the menu board of FIG. 1.
Figure 3A:
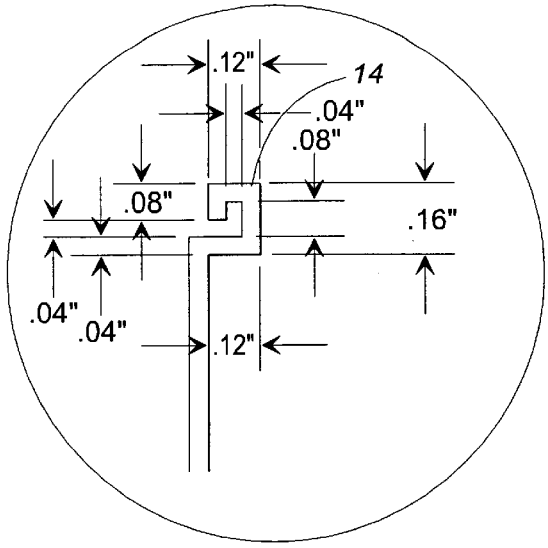
FIGS. 3A and 3B, respectively, are enlarged, partial end elevational views of the top and bottom edges A and B, respectively of the menu board of FIGS. 1A and 2.
Figure 3B:
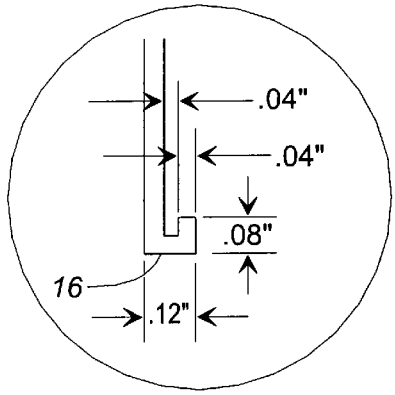
Figure 3C:
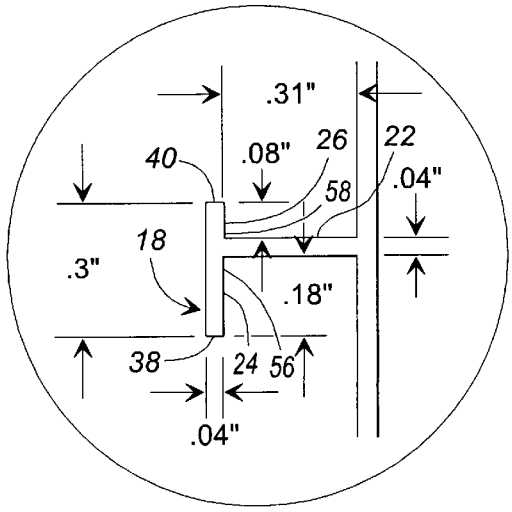
FIG. 3C is an enlarged, partial end elevational view of one of the channel dividers C of FIG. 2.

The menu board, 10 as illustrated in FIGS. 1A and 2, comprises a planar back panel 12, defined by spaced top and bottom edges 14, 16, respectively, and a series of spaced-apart, horizontal flanges 18 (FIG. 2) which define plural elongate channels 21 between adjacent ones of the flanges. The top and bottom edges 14, 16 of the back panel, as best illustrated in FIGS. 3A and 3B, are configured to be interlocking in order to join at least a pair of the menu boards together, while presenting a flat, continuous inner face. The plural horizontal flanges 18 are essentially T-shaped members having a first leg 22 perpendicular to the inner face 20, and a pair of opposed legs 24, 26, extending perpendicular to the first leg 22 and spaced from the inner face 20 to define the respective channels 21. For reasons to become apparent, hereinafter, the respective upper opposed leg 24 is longer than the lower opposed leg 26. In a preferred embodiment, the leg 26 is less than 50% of leg 24, more precisely about 44%. The length of leg 24.

Figure 5:
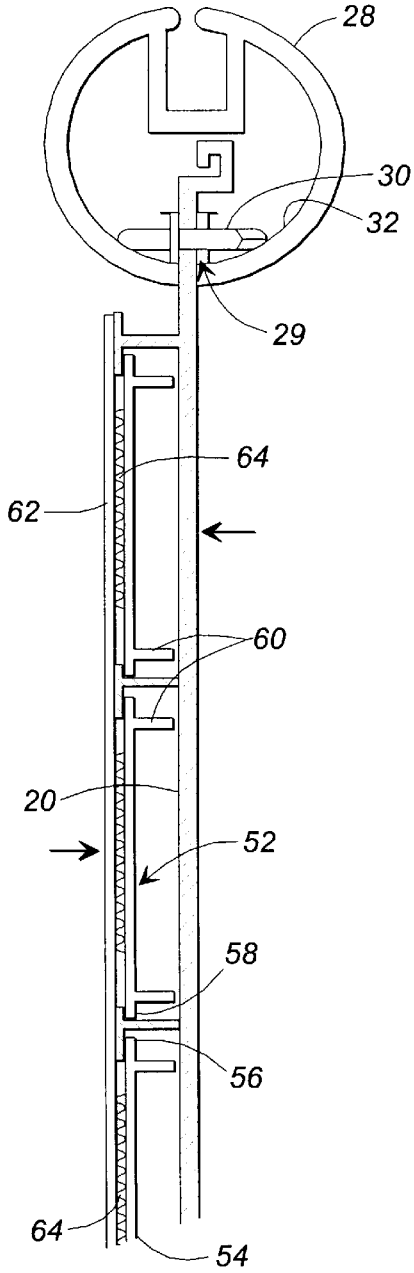
FIG. 5 is a partial, vertical cross-sectional view illustrating a second embodiment for a display insert slidably receivable in a channel of the menu board of FIG. 1, further showing the mounting of a large graphics panel to plural, aligned inserts of the second embodiment of the invention.

As an ancillary feature of the present invention, illustrated in FIG. 5, the exposed top and bottom edges 14, 16 may be dressed by the provision of a facia or trim member 28, having a longitudinal slot 29, for sliding engagement onto a respective one of the edges 14, 16. To retain the edges within member 28, a pin 30, engaging the inner wall 32 thereof, may be provided. Although member 28 is shown here as a generally cylindrical, hollow member, the facia member may be of any desired configuration so long as it is constructed for attachment to edges 14, 16, as described.

Figure 1B:
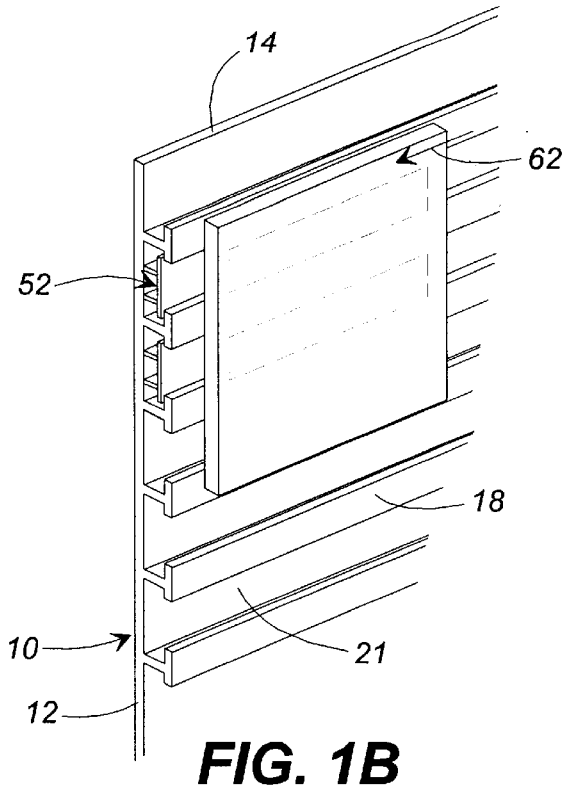
FIG. 1B is a perspective view of the menu board of FIG. 1A showing a graphics display received on a plurality of the channels of the menu board.
Figure 1C:
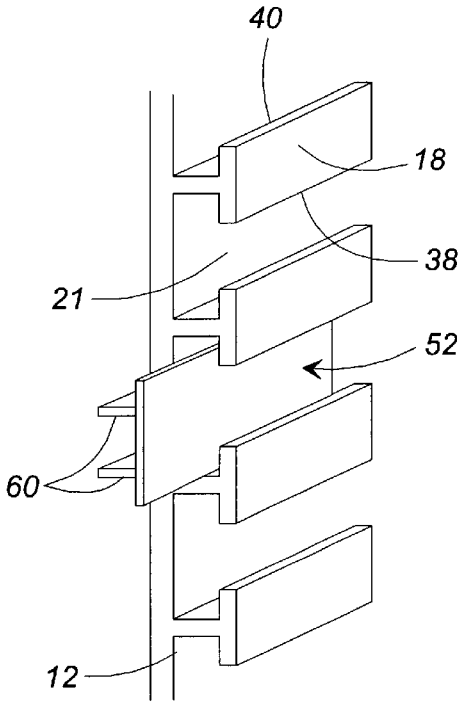
FIG. 1C illustrates the use of an extruded channel filler block within the channels of the menu board of FIG. 1A.
Figure 1D:
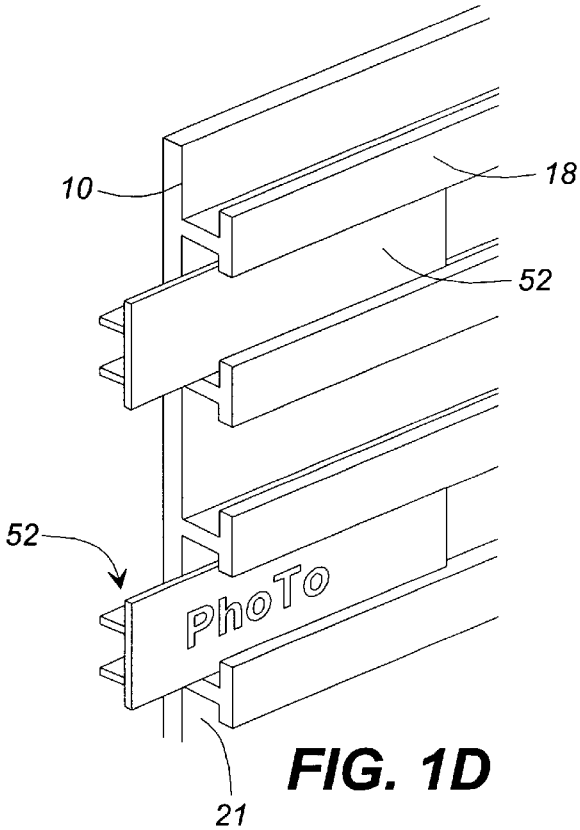
FIG. 1D illustrates the manner in which the extruded channel filler blocks of FIG. 1C may be used with graphics displays within the channels of the menu board of FIG. 1A.

As shown in FIGS. 1B–1C, the menu board 10 of this invention may be used with extruded filler blocks or inserts 52 sized and shaped to be received within a respective one of the channels 21, and extend at least partially along the length thereof, as desired. This is best shown in FIGS. 1C and 1D. Moreover, the exterior, i.e. the outwardly facing surface, of the filler extrusion block may contain a graphics display thereon, as shown in FIG. 1D, which may be either adhered thereto, for example by a double-sided adhesive tape, or may be directly printed onto the insert. So constructed, however, the filler blocks shown in FIGS. 1B–1D are slid into the channels through the ends of the channels, or may be passed upwardly beneath leg 24, and then passed over an adjacent and downwardly spaced leg 26, prior to being received within a respective one of the channels 21 of the menu board as are the embodiments of the modular display inserts disclosed herein.

As also shown in FIG. 1B, a series of filler extrusions can be passed into at least two of the channels, and an enlarged graphics display 62, here a planar display, constructed of either paper or plastic, for example, and having a graphics display on its outwardly facing surface, can be fastened to the filler blocks, again using double-sided adhesive tape. So constructed, the menu board and the filler extrusion blocks provide a system which is simple and easy to use, easy to construct, and which is relatively flexible. Still greater flexibility, however, of the invention, is disclosed in FIGS. 4–7, discussed in greater detail below.

The filler blocks 52 are also shown in FIG. 5. Filler block 52 comprises a T-shaped, or double "T", member having a front panel 54, which in the operative position, lies adjacent the respective inside faces 56, 58, respectively of opposed legs 24, 26. Extending perpendicular to and rearwardly of front panel 54, are a pair of spaced-apart legs 60. Such legs, maintain the spatial relationship of the second insert 52 to the channel 21, and space the front panel 54 from the inner face 20 of the back panel 12 of the menu board. Also, as illustrated in FIG. 1B and FIG. 5, plural inserts 52 may be vertically positioned to receive the large single graphic display panel, 62, also see FIG. 1A, where such a panel 62 may be mounted on the inserts 52 by VELCRO®-type hook and loop fastening members, or by double-sided adhesive tape 64 as shown.

Figure 4:
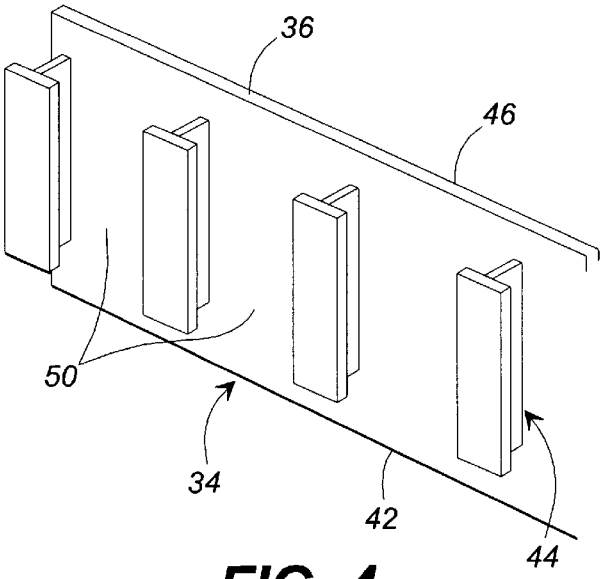
FIG. 4 is a perspective view of a first embodiment for a display insert slidably receivable in a channel of the menu board of FIG. 1A.

A unique feature of this invention is the provision of plural display inserts for sliding engagement into a respective channel 21, where said inserts may be readily lifted and removed from the channels without interfering with an adjacent insert. Accordingly, a first embodiment for such an insert 34 according to this invention is illustrated in FIG. 4. Insert 34 comprises a rear planar panel 36 vertically dimensioned to be slightly less than the distance between the opposing edges 38, 40 (FIG. 3C) of opposed legs 24, 26. Thus, by this arrangement, the insert 34 may be lifted within the channel 21 which frees the lower edge 42 from the leg 26 to thereby allow removal of the insert 34 from the channel 21. Extending from the rear planar panel 36 are plural, vertically oriented T-shaped dividers 44, spaced from the upper and lower edges 46, 42 of the panel 36. The respective channels 50, formed by adjacent dividers 44, are adapted to receive indicia bearing panels, as described later.

Figure 6A:
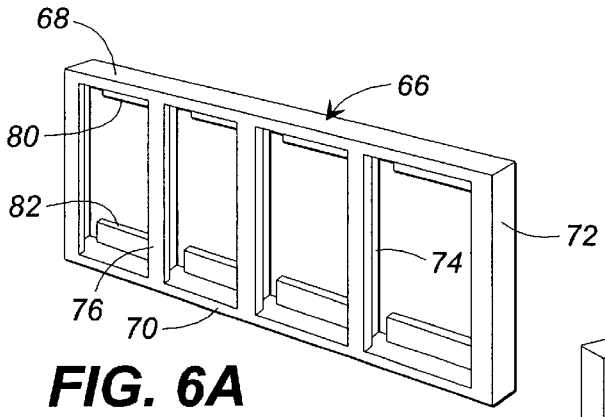
FIGS. 6A and 6B, respectively, are front and rear perspective views of a third embodiment for a display insert slidably receivable in a channel of the menu board of FIG. 1.
Figure 6B:
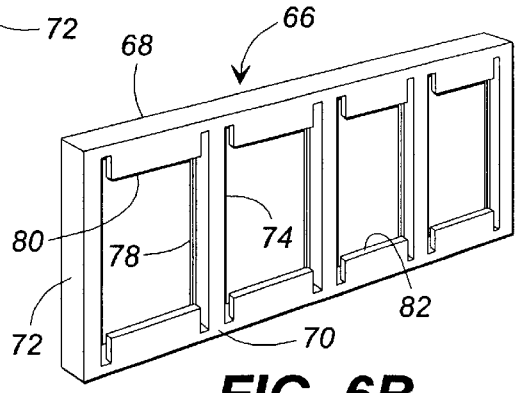
Figure 6C:
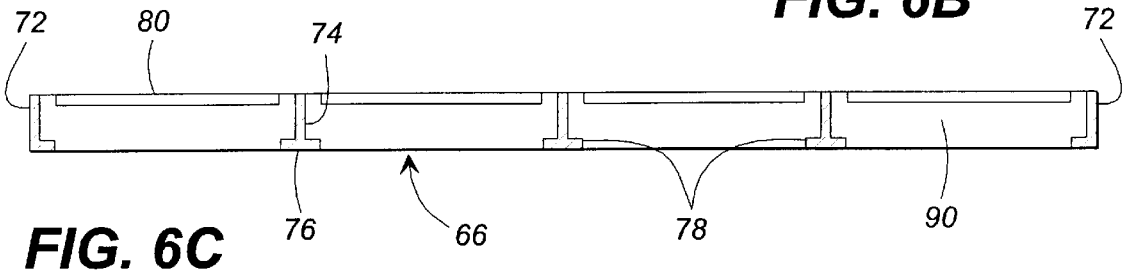
FIG. 6C is a transverse cross-sectional view taken through the insert of FIG. 6A.

A second embodiment for a slidable insert 66 is illustrated in FIGS. 6A through 6C. As best seen in FIGS. 6A and 6B, the third insert 66 comprises a housing having top member, a bottom member, and side walls 68, 70, 72, respectively, sized for sliding engagement within a channel 21. Disposed between said side walls 72, and extending vertically between the top and bottom walls 68, 70, are plural T-shaped dividers 74, where the respective caps or flanges 76 thereof define a front face for the dividers 74. Further, the lateral extensions 78 (FIG. 6C) of the caps 76 function to define front retention members for securing an indicia bearing panel therewithin, as later described. Cooperating with said front retention members are a pair of opposed, vertically extending flanges 80, 82, projecting respectively from the top and bottom members 68, 70, see FIGS. 6B and 6C. As noted above, and as is true for all inserts, the second insert 66 is vertically dimensioned for sliding receipt within the channel 20, but which can also be lifted therewithin and removed without interfering with an adjacent insert, as can insert 34 shown in FIG. 4.

Figure 7:
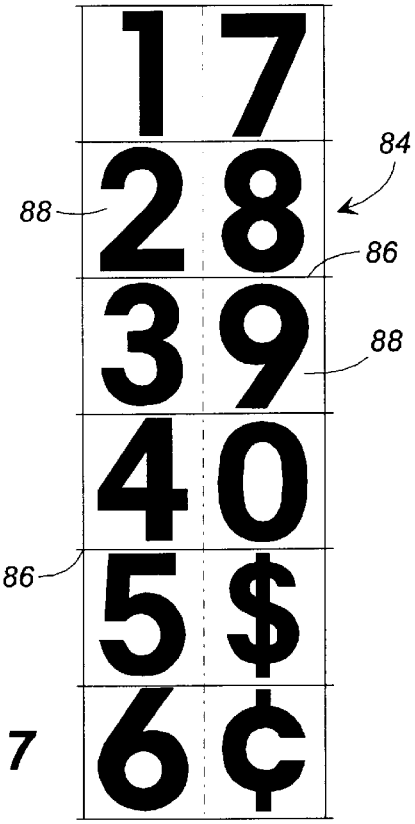
FIG. 7 is a plan view of a suitable indicia bearing panel, or number set, such as may be printed on paper or a plastic material, where the panel may be folded in an accordion-like fashion to expose a selected indicia, for use with the inserts of FIGS. 4, 6A and 6B.

FIG. 7 illustrates a typical indicia bearing panel 84 which may be folded along selected pre-scored lines 86 between panel segments 88 to expose a selected panel segment. Once the selected panel segment 88 is exposed on the fully folded panel 84, it may be inserted into the opening 90 of the third insert 66, or between dividers 44 of the first embodiment 34. Indicia bearing panel 84 may be constructed of a paper or paperboard-type material, or more preferably of a thin plastic material which can be folded along lines 86 into an accordion configuration. Thus, it is anticipated that indicia bearing panel 84 would be constructed of polyethylene, and similar plastics which can be bent, yet which will not break along lines 86.

It is anticipated that menu board 10, in its various embodiments as illustrated in FIGS. 1–7, will be fabricated of a plastic material which offers the features of relatively low cost, and which can be either extruded or injection molded in a variety of colors, and offers light weight yet possesses structural rigidity once constructed. For example, back panel 12 of menu board 10 may be extruded, whereas the embodiments of the inserts shown in FIGS. 4 and 6A–6C, may be injection molded. Menu board 10 can be constructed of any of the known family of plastics suitable for use in extrusion, and/or injection molding, to include polyethylene, polyvinylchloride, polystyrene, and polycarbonate plastics. Also, it is anticipated that the user could use channel filler blocks 52, and either, or both, of inserts 34, 66 of this invention in combination on back panel 12 of the menu board at the same time for a level of display flexibility heretofore unknown in the art.

While several embodiments of the invention have been described above, particularly as to the various filler blocks and inserts that may be utilized in the menu board of this invention, it is recognized that variations may be had with respect to the several embodiments of the invention for a quick change menu board in accordance with this invention. Therefore, while the invention has been disclosed in preferred forms only, it will be obvious to those skilled in the art that many additions, deletions and modifications can be made therein without departing from the spirit and scope of this invention, and that no undue limits should be imposed thereon except as set forth in the following claims. Moreover, the corresponding structures, materials, acts, and equivalents of all means or step plus function elements in the claims are intended to include any structure, material, or act for performing the functions in combination with other claimed elements, as specifically claimed herein.

I claim:

1. A menu board for advertising graphic and sales information comprising:

a planar back panel having a plurality of horizontally dispose channels defined by a plurality of off-set members extending perpendicular to said planar back panel, wherein each of said off-set members are T-shaped and each has a spaced pair of opposed legs extending parallel to said planar back panel;

filler blocks sized for sliding engagement within at least one of said channels between said back panel and said pair of opposed legs, said filler blocks being received vertically behind a first said opposed leg of a first off-set member and a second said opposed leg of an adjacent second off-set member and movable to a raised position free from said second opposed leg of said second off-set member for ease of removal from said channel;

at least one graphic display panel adapted to be releasibly mountable on said filler blocks; and means for mounting said at least one graphic display panel on said filler blocks to enable said at least graphic display panel to be readily mounted and replaced on said menu board.

2. The menu board of claim 1 wherein said means for mounting comprises hook and loop fastening members applied to said filler blocks and said graphic display panel for releasibly mounting said graphic display panel to said filler blocks.

3. The menu board of claim 1 and wherein said graphic display panel comprises a single large dimension panel.

* * * * *